US005137191A

United States Patent [19]

Blanchard et al.

[11] Patent Number: 5,137,191

[45] Date of Patent: Aug. 11, 1992

[54] WISHBONE HANGER

[75] Inventors: Russell O. Blanchard; Robert A. Bredeweg, both of Zeeland, Mich.

[73] Assignee: Batts, Inc., Zeeland, Mich.

[21] Appl. No.: 685,846

[22] Filed: Apr. 16, 1991

[51] Int. Cl.[5] ..... A47G 25/18; A47G 25/14

[52] U.S. Cl. ..... 223/88; 223/85; 223/92; 223/95

[58] Field of Search ..... 223/85, 88, 92, 95; 211/113; D6/315, 318

[56] References Cited

U.S. PATENT DOCUMENTS

| | | | |
|---|---|---|---|
| 2,875,930 | 3/1959 | Lerner | 223/88 |
| 2,981,451 | 4/1961 | Friedman | 223/88 |
| 3,070,269 | 12/1962 | Zuckerman | 223/88 |
| 3,085,724 | 4/1963 | Wilde | 223/85 |
| 3,257,049 | 6/1966 | Smith | 223/88 |
| 3,306,506 | 2/1967 | Batts | 223/88 |
| 3,480,285 | 11/1969 | Gingler | 223/85 X |
| 3,679,100 | 7/1972 | Brorson et al. | 223/88 |
| 4,040,546 | 8/1977 | Liebscher et al. | 223/88 |
| 4,046,293 | 9/1977 | Garrison | 223/88 |

*Primary Examiner*—Werner H. Schroeder
*Assistant Examiner*—Bibmu Mohanty
*Attorney, Agent, or Firm*—James G. Staples

[57] ABSTRACT

A two-piece garment hanger which is fastened to the top section by gluing, snap action, or, preferably, some welding which is so smooth in outside appearance that the entire surface exposed to view readily lends itself to a decorative surface produced by the HydroGrafix wood grain finish decorating system.

6 Claims, 2 Drawing Sheets

WISHBONE HANGER

This invention relates generally to garment hangers and specifically to such hangers which have a solid feel, can be assembled by gluing, snap action, or sonic welding, have a clean smooth edge with a contemporary look, and are well suited for the HydroGraFix decorating system which imparts a simulated wood finish to a plastic hanger.

BACKGROUND OF THE INVENTION

There is an increasing need for garment hangers which have a solid look and feel and, preferably, appear to be constructed of wood. Wood has a solid look and feel and, years ago, nearly all hangers were made of wood. However, today wood is prohibitively expensive as a hanger material for the mass merchandiser and hence plastic, of necessity, is the material of choice for all but a very small segment of the garment hanger market. While plastic has many desirable qualities from the manufacturing and retail selling standpoints, the consumer tends to more readily equate wood than plastic with quality and value. Hence the manufacturer and the retailer of garment hangers are faced with a dilemma in that competitive market pressures dictate that plastic be the material of choice, yet the consumer prefers the touch and feel and look of wood with the consequent quality and value impressions it connotes.

BRIEF DESCRIPTION OF THE INVENTION

The garment hanger of this invention is formed from plastic material yet, in its finished form, it has the look and feel of a wood hanger. The manufacturer and retailer thus realize the economic advantages which plastic provides while at the same time providing the customer with a hanger which has the attributes and appearance of wood. The hanger is formed from only two molded plastic pieces plus a hook and, if desired, a pant or skirt attachment. The molded plastic parts are joined together on the lower front and back rather than the top and bottom with the result that clean smooth edges are presented and the hanger has a contemporary look. The construction is so designed that gluing, snap locking, or sonic welding may be used to secure the two parts to one another, depending on the facilities available and the economics at the time of manufacture.

The invention has the further advantage that because of the smooth contour of the basic hanger structure no matter how joined, it lends itself very readily to a relatively newly developed decorative system, now known in the art as the HydroGraFix system, which enables a simulated wood finish to be applied economically and easily to a plastic structure.

BRIEF DESCRIPTION OF THE DRAWING

The invention is illustrated more or less diagrammatically in the accompanying drawing wherein.

DETAILED DESCRIPTION OF THE INVENTION

Figures 1, 2, 3:
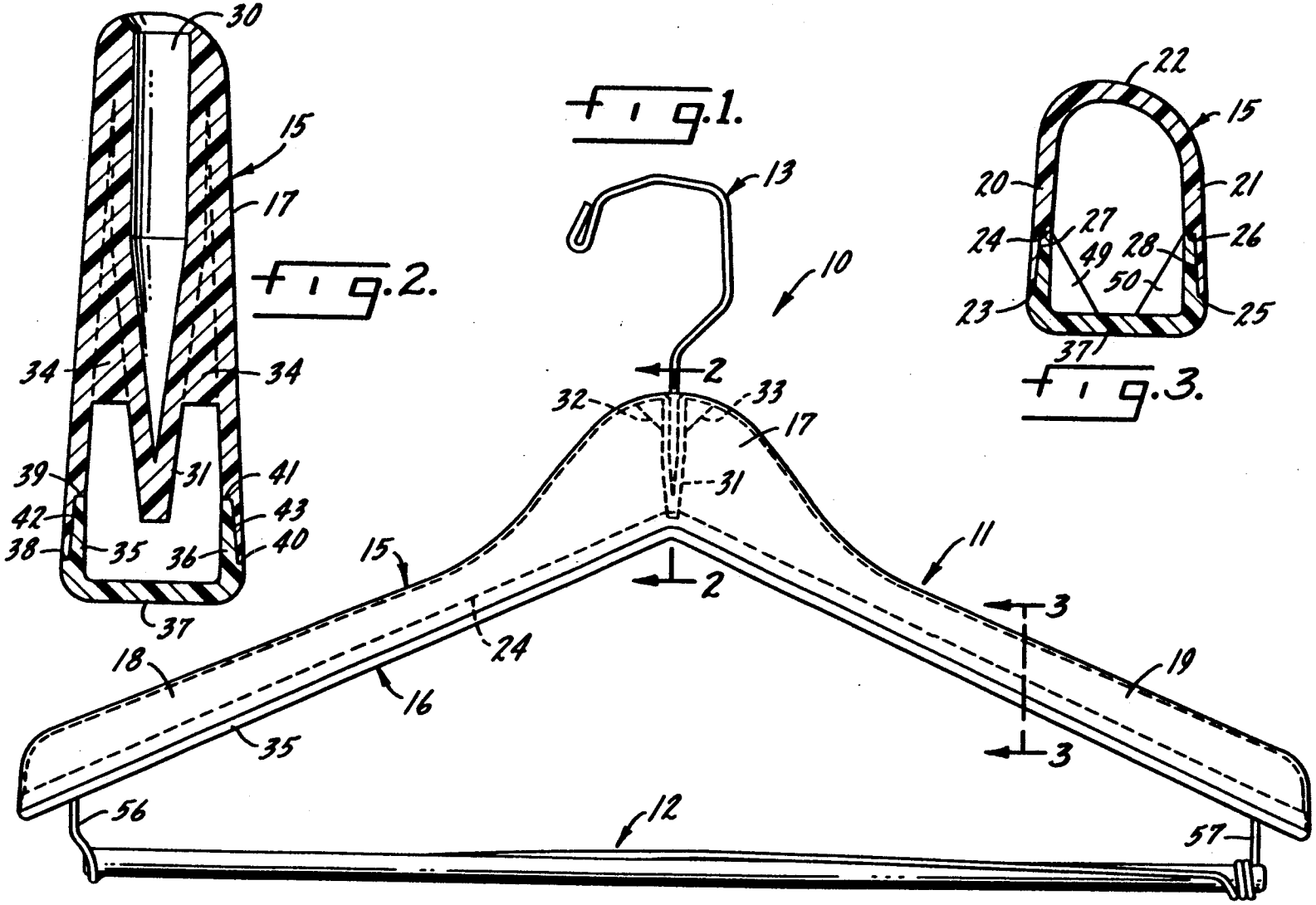
FIG. 1 is a front elevation of the garment hanger of this invention shown, in this instance, with a pant attachment.
FIG. 2 is a section taken substantially along the line 2—2 of FIG. 1 with the hook omitted for purposes of clarity.
FIG. 3 is a section taken substantially along line 3—3 of FIG. 1.

Like reference numerals will be used to refer to like or similar parts from Figure to Figure in the following description of the drawing.

The garment hanger of this invention is illustrated at 10 in FIG. 1. The hanger consists of a main garment support section, indicated generally at 11, and a garment attachment, here a pant attachment, indicated generally at 12. A suspending device, here a hook, is indicated generally at 13.

The main garment support section 11 is a two-piece structure formed by a top half 15 and a bottom half 16. Top half 15 includes a head area 17 which blends smoothly into left shoulder area 18 and right shoulder area 19.

From FIG. 3 it will be seen that the top half of 15 has a generally inverted U-shaped configuration formed by front face 20 and rear face 21, which faces are joined by bight portion 22. The lower surface of each of front and rear faces 20, 21 are stepped as best seen at 23 on the outside and 24 on the inside of the front face 20, and at 25 on the outside and at 26 on the inside of the rear face 21. A pair of elongated abutment faces 27 and 28 are thereby provided between the generally horizontal surfaces which define the steps to assist in the securement of the top and bottom halves of the hanger as will appear hereinafter. A typical hook recess 30, see FIG. 2, is formed in a downwardly extending boss 31 in the center of the top half to receive hook 13 or other suitable suspending mechanism. Left and right reinforcement struts 32, 33 extend downwardly from the underside of the top half into integral engagement with the hook boss 31 to provide strength and rigidity to the suspending means which is subjected to the greatest stress of any part in use. Transverse reinforcement struts are indicated at 34.

Figures 4, 5, 6, 7, 8:
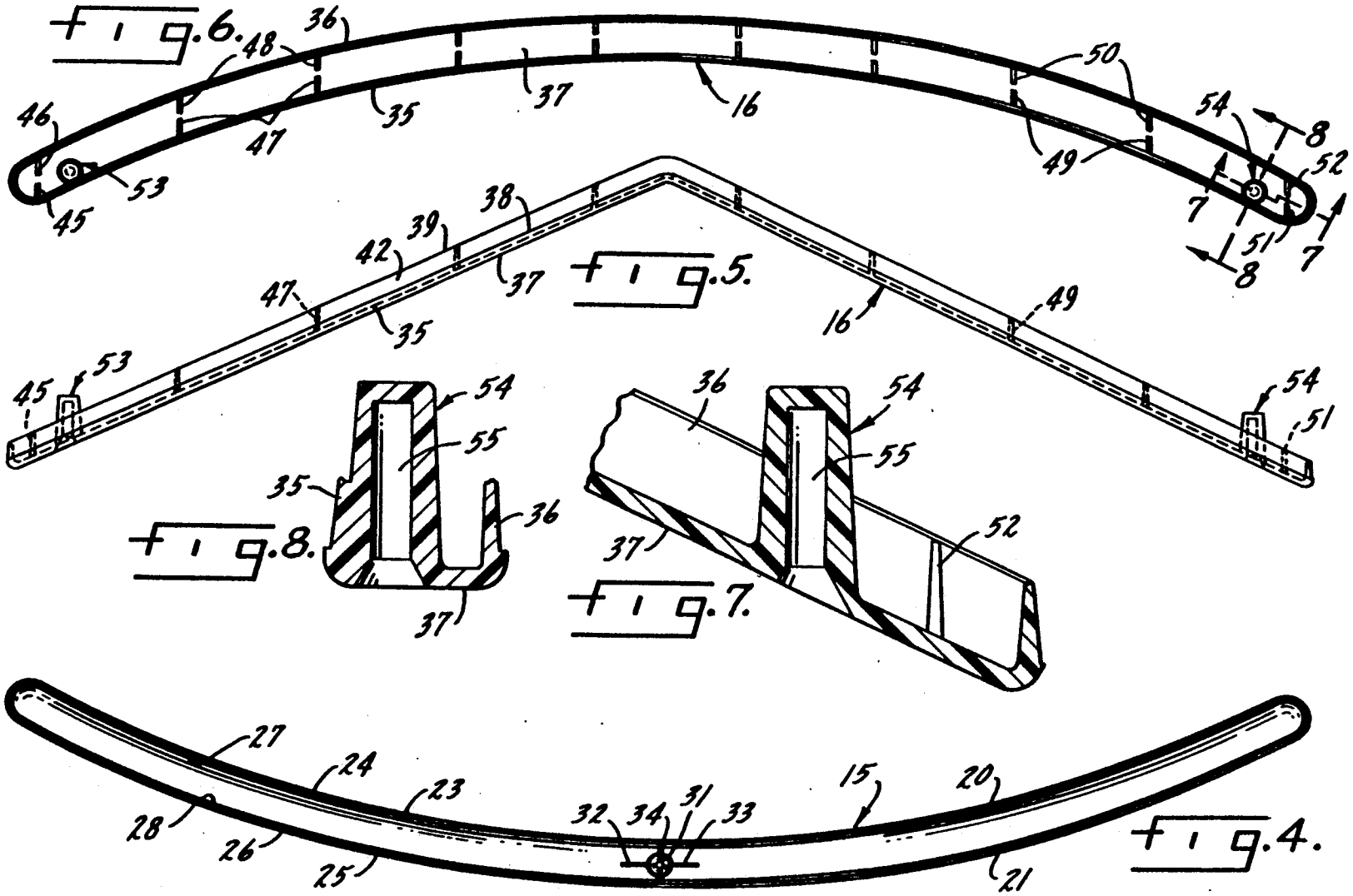
FIG. 4 is a bottom view of the top half of the hanger of FIG. 1.
FIG. 5 is a front elevation of the bottom half of the hanger of FIG. 1.
FIG. 6 is a top plan view of the bottom half of the hanger of FIG. 1.
FIG. 7 is a section taken substantially along the line 7—7 of FIG. 6.
FIG. 8 is a section taken substantially along the line 8—8 of FIG. 6.

From FIGS. 1-3, 5 and 6, it will be noted that the lower half 16 has the shape of a very open inverted capital V, see particularly FIG. 5. The lower portion includes front and back sidewalls 35, 36 respectively, which are slightly curved in plan view as best seen in FIG. 6. Bottom wall 37 connects sidewalls 35, 36 to form a generally U-shaped cross section as best seen in FIGS. 2 and 3. Front wall 35 is stepped as at 38 and 39 and rear wall 36 is stepped as at 40, 41. A front abutment face is indicated at 42 and a rear abutment is indicated at 43. From FIGS. 2 and 3, it will be appreciated that the stepped portions of the front and rear walls of the top and bottom halves are complementarily contoured so that a snug fit results when they are brought into engagement with one another.

Referring now to FIGS. 3 and 6, it will be noted that a plurality of generally triangular stiffening wings 45-46, 47-48, 49-50 and 51-52 extend outwardly from the top of the inside surface of front wall 35 and rear wall 36 toward the center of the bottom wall 37.

Referring now to FIGS. 5-8, a pair of attachment bosses are indicated generally at 53,54. Attachment boss 54 fuses into front wall 35 as best seen in FIGS. 6 and 8, and has a recess 55 which is constructed to receive a pant or skirt attachment, such as the wire ends 56, 57 of pant attachment 12.

One of the unique features of the invention is that the stepped faces of front and rear walls 20 and 21 of the top half 15 and the stepped faces of the front and rear walls 35 and 36 of the lower half are joined at the front and back of hanger 10 rather than at the top and bottom as is so common. Further, the top and bottom halves may be joined by gluing, snap action or sonic welding. At the present time sonic welding is the preferred fastening procedure. No matter which procedure is followed, however, the wide abutment faces 27, 42 and 28, 43 provide maximum abutting securement areas as contrasted, for example, to a simple horizontal surface match which is what is provided by, in effect, surfaces 38, 23 and 39, 24.

Since the two pieces are molded from plastic, and the parts may be so precisely formed that the joint line between the top and bottom halves is almost imperceptible, a wood grain area is provided which is particularly well adapted to receive a simulated wood finish applied by the HydroGraFix process which has recently come into use for applying wood grain finish to plastic surfaces. In addition, a finger joint texture can be applied to each side of the head area for easy grasping by the user. As a result of the joinder of the top and bottom halves on the lower front and back rather than the top and bottom, a clean, smooth edge and contemporary look results.

Although a preferred embodiment of the invention has been illustrated and described, it will at once be apparent to those skilled in the art that variations may be made within the spirit and scope of the invention. Accordingly, it is intended that the scope of the invention be limited solely by the scope of the hereafter appended claims and not by the specific words in the foregoing description.

We claim:

1. A garment hanger comprising a one-piece smoothly contoured garment support member having an upper edge and a lower edge arranged to receive and suspend a garment in contact therewith, a one-piece closure member having an upper edge and a lower edge received on the underside of the garment support member, the contour of the upper edge of the closure member generally conforming to the contour of the lower edge of the garment support member, a portion of the lower edge of the garment support member and a portion of the upper edge of the closure member being in abutting, overlapping relationship one to the other when assembled, wherein the two members, when in engagement, form a unitary structure with a joint line along the lower front and back of the garment hanger, suspension means associated with the garment support member, the closure member including anchor means for receiving a pant or skirt hanging attachment structure, said anchor means comprising a boss structure integrally formed with the closure member at each end thereof to receive and retain end portions of said attachment structure.

2. A garment hanger comprising a one-piece smoothly contoured upper garment contacting member arranged to receive and suspend a garment in contact therewith said member having a lower edge, said one-piece upper garment support member having an inverted U-shaped cross section with an open bottom, a one-piece lower closure member having an upper edge and a lower edge received within the open bottom of the U-shaped upper member, the contour of the upper edge of the lower closure member conforming to the contour of the lower edge of the garment contacting member, the lower edge of the upper member and the upper edge of the lower member being secured to one another in abutting relationship along a generally horizontally oriented joint line at the lower ends of the legs of the inverted U-shaped configuration of the upper member, said two members, when in engagement, forming a unitary structure with a generally horizontally oriented joint line along the lower front and back of the hanger.

3. The garment hanger of claim 2 in which the garment hanger is formed from plastic and all surfaces of the hanger, except the bottom, when exposed to view in assembled condition, have a simulated decorative finish.

4. The garment hanger of claim 2 in which the upper garment contacting member and the closure member are sonically welded to one another at their abutting surfaces.

5. The garment hanger of claim 2 further including a pant or skirt hanging attachment which is secured to the end portions of the unitary garment hanger.

6. The garment hanger of claim 5 including boss means integrally formed with the closure member at each end thereof to receive and retain the end portions of said attachment structures.

* * * * *